US010562334B2

(12) United States Patent
Mercier

(10) Patent No.: US 10,562,334 B2
(45) Date of Patent: Feb. 18, 2020

(54) SECURITY DOCUMENTS WITH TEXT PRINTING SECURITY FEATURE

(71) Applicant: ASSA ABLOY AB, Stockholm (SE)

(72) Inventor: Frantz Mercier, Hollister, CA (US)

(73) Assignee: ASSA ABLOY AB, Stockholm (SE)

( * ) Notice: Subject to any disclaimer, the term of this patent is extended or adjusted under 35 U.S.C. 154(b) by 0 days.

(21) Appl. No.: 15/899,062

(22) Filed: Feb. 19, 2018

(65) Prior Publication Data

US 2019/0255875 A1 Aug. 22, 2019

(51) Int. Cl.

| | |
|---|---|
| ***B42D 15/00*** | (2006.01) |
| ***B42D 25/405*** | (2014.01) |
| ***B42D 25/30*** | (2014.01) |
| ***B41M 3/14*** | (2006.01) |

(52) U.S. Cl.
CPC ..... *B42D 25/405* (2014.10); *B41M 3/14* (2013.01); *B42D 15/00* (2013.01); *B42D 25/30* (2014.10)

(58) Field of Classification Search
CPC ..... B42D 15/00; B42D 2035/08
USPC ..... D18/24
See application file for complete search history.

(56) References Cited

U.S. PATENT DOCUMENTS 5,573,639 A * 11/1996 Schmitz ..... B42D 25/355 428/916
7,758,078 B2 7/2010 Keller
2009/0250920 A1* 10/2009 Isherwood ..... B42D 25/29 283/91

OTHER PUBLICATIONS

Building Custom Text with CSS (TJ VanToll) https://www.tjvantoll.com/2013/09/12/building-custom-text-strikethroughs-with-css/ (Year: 2013).*
How to Strikethough Obliquely with CSS https://stackoverflow.com/questions/14593415/how-to-strike-through-obliquely-with-css (Year: 2013).*
"International Application Serial No. PCT/EP2019/054118, International Search Report dated Apr. 5, 2019", 3 pgs.
"International Application Serial No. PCT/EP2019/054118, Written Opinion dated Apr. 5, 2019", 5 pgs.
Helmut, Kipphan, "Handbook of Print Media", Springer Verlag, Berlin / Heidelberg XP002789970 New York—not in English, (2000), 4 pgs.

* cited by examiner

*Primary Examiner* — Kyle R Grabowski
(74) *Attorney, Agent, or Firm* — Schwegman Lundberg & Woessner, P.A.

(57) ABSTRACT

Printing or engraving or other techniques and resulting security documents can help inhibit or prevent tampering or forgery, such as by providing a strikethrough path through characters in a word. A characteristic of the strikethrough path can depend upon a characteristic of the word. For example, the strikethrough path can alternatingly ascend and descend through successive words in a sequence, such that the location of the strikethrough path within a particular character depends on that particular character, upon a location of the character within the word, or both. The strikethrough path can be constructed such that if characters are copied or excised and re-arranged, such re-arrangement is evident by misalignment of one or more portions of the strikethrough path that would otherwise be aligned in the original document.

11 Claims, 3 Drawing Sheets

SECURITY DOCUMENTS WITH TEXT PRINTING SECURITY FEATURE

TECHNICAL FIELD

This document pertains generally, but not by way of limitation, to printing techniques for producing security documents and other articles of manufacture.

BACKGROUND

Security printing is the field of the printing industry that deals with the printing of security documents such as banknotes, currency, checks, passports, driver's licenses, identification (ID) cards, credit cards, birth certificates, tamper-evident labels, pharmaceutical packaging or other product authentication, stock certificates, bonds, postage stamps, event tickets, sporting cards (e.g., baseball cards), playing cards (e.g., such as for gambling), wills or other legal documents, among other examples.

A goal of security printing is to prevent forgery, tampering, or counterfeiting. For example, Keller U.S. Pat. No. 7,758,078 is directed toward a security element and method for producing the same. Security printing can be done on commercial printers like traditional offset and flexographic presses, as well as using newer digital platforms.

SUMMARY

The present disclosure recognizes, among other things, that a challenge faced in printing security documents is how to inhibit or prevent forgery or tampering. Such tampering or forgery can include copying or excising characters that were printed in a font that is particular to the security document, and then re-arranging such characters to form one or more words different from those originally printed. An illustrative example would be to change the name on an identity document, such as starting from characters copied or excised from one or more other identity documents. Changing the name by re-arranging such copied or excised characters can be detected by visual inspection by a human or machine, using the techniques of the present subject matter, such as described herein.

The present subject matter includes printing techniques and resulting security documents that can help inhibit or prevent such tampering or forgery, such as by providing a strikethrough path through characters in a word. As explained further herein, the strikethrough path can be constructed such that if characters are copied or excised and re-arranged, such re-arrangement is evident by misalignment of one or more portions of the strikethrough path that would otherwise be aligned in the original document.

BRIEF DESCRIPTION OF THE DRAWINGS

In the drawings, like numerals may describe similar components in different views. Like numerals having different letter suffixes may represent different instances of similar components. The drawings illustrate generally, but not by way of limitation, various embodiments discussed in the present document.

DETAILED DESCRIPTION

The present subject matter includes printing or engraving techniques and resulting security documents that can help inhibit or prevent tampering or forgery, such as by providing a strikethrough path through characters in a word. As explained further herein, the strikethrough path can be constructed such that if characters are copied or excised and re-arranged, such re-arrangement is evident by misalignment of one or more portions of the strikethrough path that would otherwise be aligned in the original document.

Figure 1:
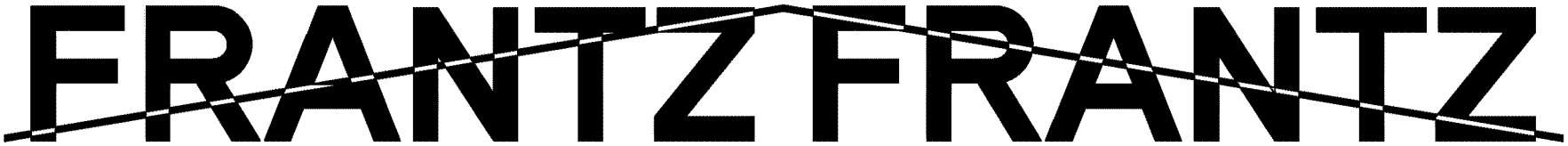
FIG. 1 is an illustrative example of words that can be printed on a page or other substrate in a security document or other article of manufacture, such as can help inhibit or prevent tampering or forgery.

FIG. 1 is an illustrative example of one or more words that can be printed, engraved, or otherwise formed on a paper page or other substrate, such as in a security document or other article of manufacture, such as can help inhibit or prevent tampering or forgery. Some illustrative examples of other possible substrates include, without limitation: polycarbonate, polyvinyl chloride (PVC), cardboard, plastic wrap, metal, glass, or the like.

In the example of FIG. 1, a sequence of one or more characters can include one or more alphanumeric characters, such as can be printed, engraved, or otherwise formed using a desired proportional or non-proportional font, such as for use in a security document. The sequence of characters can include or be arranged in one or more words. The one or more words can be arranged in one or more rows on the substrate, such as in the manner of printed text, such as can be readable from left-to-right, or otherwise.

In FIG. 1, the characters can define first contrast regions. For example, if printed upon a generally relatively lighter substrate, the first contrast regions can include generally visually or optically darker regions than the background lighter substrate—such as with the exception of a strikethrough path extending through the first contrast regions of the characters, such as explained further herein. As seen in FIG. 1, the sequence of characters includes a first word "FRANTZ" followed by an adjacent second word "FRANTZ" in the same row.

In the example of FIG. 1, the characters can be printed onto the substrate such that a strikethrough path extends through an individual word. As explained herein, the combination of: (1) a particular character and (2) the strikethrough path through that particular character, can be characteristic of the particular character and the position of that particular character within the word through which the strikethrough path extends. This can help inhibit tampering or forgery. If the characters are copied or excised from the security document and re-arranged in a different order to form a different word, a discontinuity in the strikethrough path resulting from such character repositioning can help make such tampering or forgery easier for a human observer to discern visually, or for an image-processing device to recognize.

In the example of FIG. 1, the strikethrough path can extend from a leading portion of the base of the first character ("F") in the first word ("FRANTZ") to a trailing portion of a top of the last character ("Z") in the first word ("FRANTZ"). Optionally, the strikethrough path can than continue therefrom, such as in a contiguous manner, such as from a leading portion of a top of the first character ("F") in the second word ("FRANTZ") to a trailing portion of a base of the last character ("Z") in the second word ("FRANTZ"). Similarly, the strikethough path can continue therefrom in subsequent words in the same row, such as in a contiguous manner, such as alternatingly ascending and descending through adjacent individual words in the sequence.

Thus, in this example, the strikethrough path can extend through individual ones of the words in a manner that can depend upon a length of the word through which the strikethrough path extends. For example, the ascending strikethrough path through the first word can extend at a strikethrough angle from a leading portion of the base of the first character ("F") in the first word ("FRANTZ"). The angle can be defined, for example, with respect to a horizontal line extending along a base (or extending along a top) of all the characters of the sequence of characters of the row. As can be seen from FIG. 1, the angle will depend on the length of the word, which, in turn, will depend upon the number of characters in the word and—if a non-proportional font is used—upon the particular characters forming the word. For example, the first word ("FRANTZ") has six characters. A longer word, such as "FRANCINE", having eight letters, would have a strikethrough path ascending (or descending) at a lesser angle with respect to a horizontal line extending along a base or top of all the characters of the sequence of characters of the row. Thus, the strikethrough angle can be word-length dependent.

Thus, for a particular character at a particular location within a particular word, the location of the trace of the strikethrough path through that character will depend upon the position of that particular character within the word through which the strikethrough path extends. This can help inhibit tampering or forgery. If the characters are copied or excised from the security document and re-arranged in a different order to form a different word, a discontinuity in the strikethrough path resulting from such character repositioning will become visually evident. This can help make such tampering or forgery easier for a human observer to discern visually, or for an image-processing device to recognize.

In order for the strikethrough path to be visually observable, the strikethrough path can use a different contrast type than the contrast type used for rendering the character itself. For example, if a dark contrast (e.g., "positive contrast") is used to print dark characters on a light page or other substrate, then such dark regions defining the character can be intersected by portions of a strikethrough line providing a light contrast through the dark character. This can help make the strikethrough path visually discernable. Regions between dark characters can be provided with a dark contrast portion of the strikethrough path, such as to help make the strikethrough path visually observable. Light regions defined within a dark character, such the interior region within a closed-loop "O" or similar interior light regions bounded by, intermediate to, or between dark regions of the character (e.g., light regions within a dark "A" or "R") can be provided with a dark contrast portion of the strikethrough line or path, to make the strikethrough line or path visually observable. If light characters are printed on a darker substrate (e.g., "negative contrast" example), than the strikethrough line or path can similarly be made of an opposite contrast, such as with dark portions of the strikethrough line or path extending through light regions of the character, and light portions of the strikethrough line or path extending between such light characters and within interior regions defined by such light characters.

The strikethrough line or path can be a straight line, such as shown in FIG. 1. However, this is not required. The strikethrough line or path can be a wavy or undulating continuous strikethrough path, if desired. Such an undulating strikethrough path can extend ascendingly from the leading portion of the base of the first character of the first word to a trailing portion of the top of the last character of the first word. Such an undulating strikethrough path can then continue through the second word to extend descendingly from the leading portion of the top of the first character of the second word to a trailing portion of the base of the last character of the second word. Such an undulating strikethrough path can continue on to alternatingly ascend and descend through adjacent words in the row, such as in a contiguous manner.

In the example of FIG. 1, because of the ascending and descending angles of the strikethrough path, alternating through successive words in a sequence of words forming a row on a page or other substrate, the height of the strikethrough path through a particular character will depend upon the position of that character within a particular word, and upon the word length, which, in turn, will depend upon the number of characters within the word and upon the length of such individual characters, such as if a non-proportional font is used such that each individual character can have a length that need not be the same as that of other characters.

Figure 2:
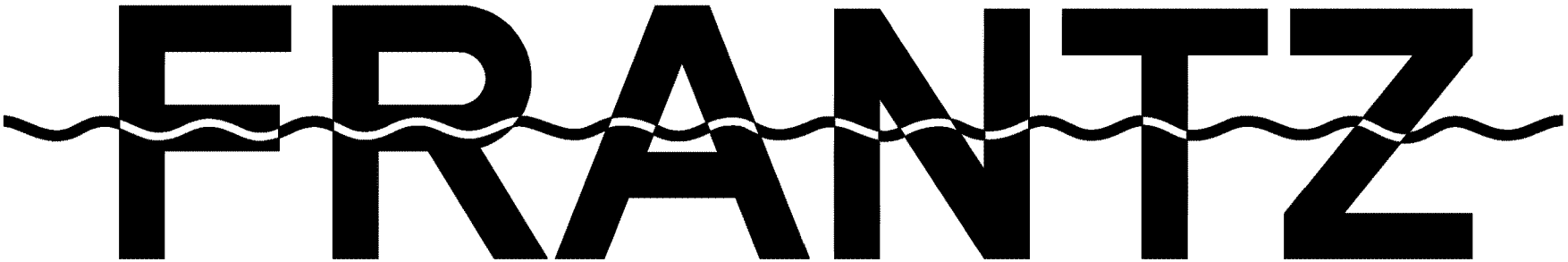
FIG. 2 shows an example with an undulating strikethrough path extending through a word.

FIG. 2 shows an example with an undulating strikethrough path extending through a word. In this example, the strikethrough path does not extend through the word at an angle, but instead extends through the word in a generally horizontal manner. Instead of the angle being a characteristic depending upon the word length, another characteristic can be selected, in this example, to depend upon the word length. For example, a height of the strikethrough path, e.g., relative to a selected on of the base or top of the row of characters, can be made a function of the word length. For example, a shorter word can have the strikethrough path closer to the base of the characters and a longer word can have the strikethrough path closer to the top of the characters. This approach is possible, but is a bit more challenging in that the selected height must accommodate an arbitrarily-selected longest word. The undulation amplitude can be selected so as to permit discerning a visually observable discontinuity within a word if characters are copied or excised and re-arranged to form a different word. In this example, a contiguous line between adjacent words is possible, but not required. Forgery or tampering detection can depend upon visual observation of discontinuities within words. In the presence of discontinuities between words in an un-altered document, such visual observation of discontinuities between words may be more difficult for a human observer, but is still possible.

Although the above description has mentioned printing such characters and strikethrough path on a paper page or other substrate, the characters and strikethrough path can be formed in other manners and upon other substrates as well. For example, a laser engraving process can be used to form the characters and strikethrough path, such as on a plastic substrate. Moreover, while the color contrast of the strikethrough path for visual observation has been emphasized, other contrasts are also possible. For example, if laser engraving is used to create a raised or depressed region to define a character, than an opposite-type of depressed or raised or depressed region can be used to define the strikethrough line or other strikethrough path. Also, while the examples have used an English alphabet (e.g., with 26 characters) to provide alphanumeric characters, the present techniques can be used with characters or numbers of other alphabets of other languages or numbering systems, or with a language that defines entire words (e.g., pictorially) rather than defining individual characters within a word.

Recapping with respect to the example of FIG. 1, each word can have a strikethrough line that starts at the bottom left-hand corner of a word and ends at the top right corner of the word so the next word starts at the top left corner. Alternatively, each word can have a strikethrough line that starts at the top left-hand corner of a word and ends at the bottom right corner of the word so the next word starts at the bottom left corner. In either case, this allows you to have twenty-six characters or letters (e.g., for an English alphabet), but depending on how long a word is, it changes the angle of the interaction for the strikethrough line that appears to go through the whole word. A security feature lies in the contrasting white region of the strikethrough line going through the dark region of the letter. There are thousands of possibilities for each character depending on where it is in a word structure. Because of this, the only way that a counterfeiter can even personalize a blank security document, would be to create artwork that looks like the end result, which is time consuming to do for just one layout. These character fonts can be "locked" together in this manner for personalized documents. As explained herein, such characters must fit together, as can be observed visually by visually observing the strikethrough path by a human or machine and looking for discontinuities that can indicate forgery or tampering by piecing characters together from another security document.

Figure 3:
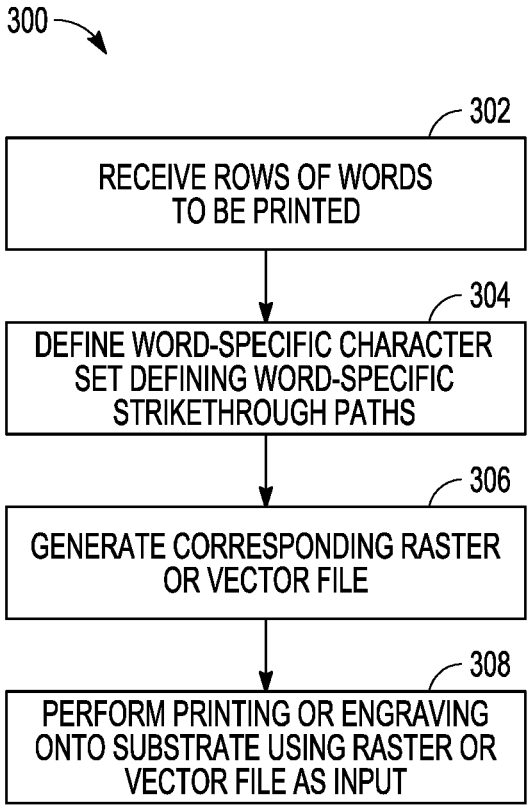
FIG. 3 shows an example of a method of printing, engraving, etching, embossing, or otherwise modifying a substrate of a security document or other article of manufacture, such as using one or more of the present techniques.

FIG. 3 shows an example of a method 300 of printing, engraving, etching, embossing, or otherwise modifying a substrate of a security document or other article of manufacture, such as using one or more of the present techniques. At 300, information about rows of words, such as can be formed using alphanumeric or other characters, can be received, such as via an input file that can be received at a computer-implemented or other printer or engraver controller or driver circuit.

Figure 4:
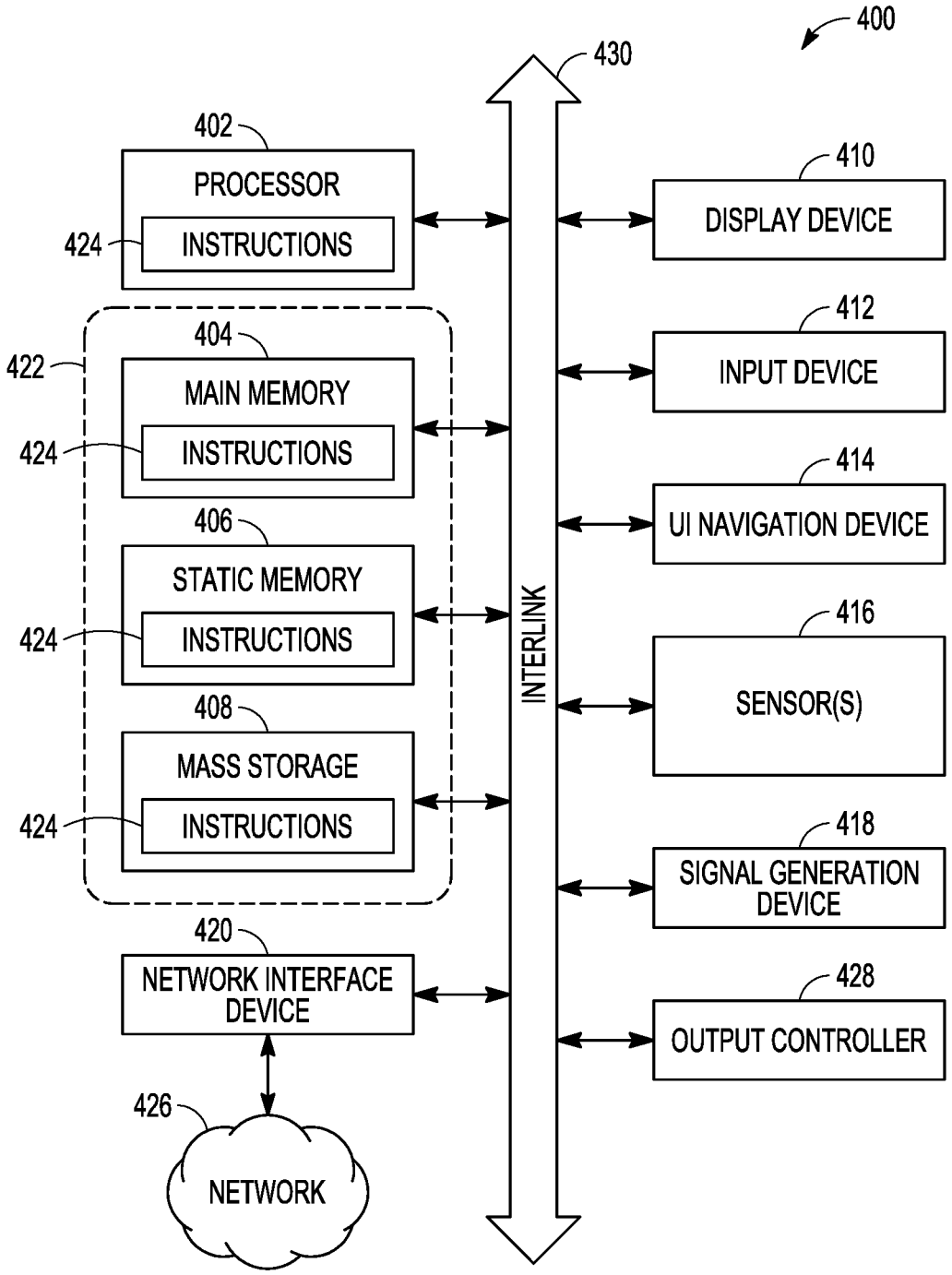
FIG. 4 is a block diagram illustrating an example of a machine upon which one or more embodiments of one or more portions of the present subject matter may be implemented.

At 304, such rows of words can be parsed or analyzed by the printer or engraver controller or driver circuit, such as to define a word-specific character set that defines word-specific strikethrough paths, such as described elsewhere herein. This can include defining a word-specific character set with alternatingly ascending and descending linear, undulating, or other strikethrough paths, such as can depend upon word-length, such as explained herein with respect to FIG. 1. Alternatively or additionally, this can include defining a word-specific character set with a variable-height linear, undulating, or other strikethrough path, such as can depend upon word-length, such as explained herein with respect to FIG. 2. Such rows of words need not be parsed or analyzed by the printer or engraver controller or driver circuit, but can instead be parsed or analyzed elsewhere, such as by another computing device, such as shown in FIG. 4, and resulting information defining word-specific character sets can be provided to the printer or engraver controller or driver circuit.

At 306, such word-specific character sets can be used by the printer or engraver controller or driver circuit to generate a raster or vector file for use by a printer or engraver for printing text with a security feature onto a security document or other article of manufacture. Such a raster or vector file can include information for providing strikethrough path through text as a security feature, such as described elsewhere herein.

At 308, printing or engraving or the like can be performed onto the substrate, such as using the raster or vector file as input for controlling the printing or engraving, such as in a manner that can provide a strikethrough path through text as a security feature, such as described elsewhere herein.

As explained herein with respect to FIGS. 1-2, the printing or engraving or the like can define a strikethrough path extending through individual ones of the words of the text, such as in a manner such that re-arranging characters into new words results in unalignment of two or more portions of the strikethrough path. Such misalignment can be detected by a human, such as using visual inspection, optionally with the aid of a visualization device (e.g., such as a camera or an imager) or a visualization-assistance device (e.g., such as a magnifying lens or other optics). Or such misalignment can be detected by a machine, such as can include or be coupled to an imaging device and an image signal-processing device. One or more image processing techniques can be applied to detect such misalignment in portions of the strikethrough path, such as by detecting a discontinuity in the strikethrough path, such as within a word of the text, for example.

FIG. 4 illustrates a block diagram of an example machine 400 upon which any one or more of the techniques or methodologies discussed herein may perform. In an example, the machine 400 can serve as a printer or engraver driver circuit and can include or be coupled to a printer device, an engraver device, an embossing device, or the like. Examples, as described herein, may include, or may operate by, logic or a number of components, or mechanisms in the machine 400. Circuitry (e.g., processing circuitry) is a collection of circuits implemented in tangible entities of the machine 400 that include hardware (e.g., simple circuits, gates, logic, etc.). Circuitry membership may be flexible over time. Circuitry can include members that may, alone or in combination, perform specified operations when operating. In an example, hardware of the circuitry may be immutably designed to carry out a specific operation (e.g., hardwired). In an example, the hardware of the circuitry may include variably connected physical components (e.g., execution units, transistors, circuits, etc.) including a machine readable medium physically modified (e.g., magnetically, electrically, moveable placement of invariant massed particles, etc.) to encode instructions of the specific operation. In connecting the physical components, the underlying electrical properties of a hardware constituent are changed, for example, from an insulator to a conductor or vice-versa. The instructions can enable embedded hardware (e.g., the execution units or a loading mechanism) to create members of the circuitry in hardware via the variable connections to carry out portions of the specific operation when in operation. Accordingly, in an example, the machine readable medium elements are part of the circuitry or are communicatively coupled to the other components of the circuitry when the device is operating. In an example, any of the physical components may be used in more than one member of more than one circuitry. For example, under operation, execution units may be used in a first circuit of a first circuitry at one point in time and reused by a second circuit in the first circuitry, or by a third circuit in a second circuitry at a different time. Additional examples of these components with respect to the machine 400 follow.

In various embodiments, the machine 400 may operate as a standalone device or may be connected (e.g., networked) to one or more other machines. In a networked deployment, the machine 400 may operate in the capacity of a server machine, a client machine, or both in server-client network environments. In an example, the machine 400 may act as a peer machine in peer-to-peer (P2P) (or other distributed) network environment. The machine 400 may include a personal computer (PC), a tablet PC, a set-top box (STB), a personal digital assistant (PDA), a mobile telephone, a web appliance, a network router, switch or bridge, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the techniques methodologies discussed herein, such as cloud computing, software as a service (SaaS), or other computer cluster configurations.

The machine (e.g., computer system) 400 may include a hardware processor 402 (e.g., a central processing unit (CPU), a graphics processing unit (GPU), a hardware processor core, or any combination thereof), a main memory 404, a static memory (e.g., memory or storage for firmware, microcode, a basic-input-output (BIOS), unified extensible firmware interface (UEFI), etc.) 406, and mass storage 408 (e.g., hard drive, tape drive, flash storage, or other block devices) some or all of which may communicate with each other via an interlink (e.g., bus) 430. The machine 400 may further include a display unit 410, an alphanumeric, voice, or other input device 412 (e.g., a keyboard), and a user interface (UI) navigation device 414 (e.g., a mouse). In an example, the display unit 410, input device 412 and UI navigation device 414 may be or include a touch screen display. The machine 400 may additionally include a storage device (e.g., drive unit) 408, a signal generation device 418 (e.g., a speaker), a network interface device 420, and one or more sensors 416, such as a global positioning system (GPS) sensor, compass, accelerometer, or other sensor. The machine 400 may include an output controller 428, such as a serial (e.g., universal serial bus (USB), parallel, or other wired or wireless (e.g., infrared (IR), near field communication (NFC), etc.) connection to communicate or control one or more peripheral devices (e.g., a printer, card reader, etc.).

Registers of the processor 402, the main memory 404, the static memory 406, or the mass storage 408 may be, or include, a machine readable medium 422 on which is stored one or more sets of data structures or instructions 424 (e.g., software) embodying or utilized by any one or more of the techniques or functions described herein. The instructions 424 may also reside, completely or at least partially, within any of registers of the processor 402, the main memory 404, the static memory 406, or the mass storage 408 during execution thereof by the machine 400. In an example, one or any combination of the hardware processor 402, the main memory 404, the static memory 406, or the mass storage 408 may constitute the machine readable media 422. While the machine readable medium 422 is illustrated as a single medium, the term "machine readable medium" may include a single medium or multiple media (e.g., a centralized or distributed database, and/or associated caches and servers) configured to store the one or more instructions 424.

The term "machine readable medium" may include any medium that is capable of storing, encoding, or carrying instructions for execution by the machine 400 and that cause the machine 400 to perform any one or more of the techniques of the present disclosure, or that is capable of storing, encoding or carrying data structures used by or associated with such instructions. Non-limiting machine readable medium examples may include solid-state memories, optical media, magnetic media, and signals (e.g., radio frequency signals, other photon based signals, sound signals, etc.). In an example, a non-transitory machine readable medium comprises a machine readable medium with a plurality of particles having invariant (e.g., rest) mass, and thus are compositions of matter. Accordingly, non-transitory machine-readable media are machine readable media that do not include transitory propagating signals. Specific examples of non-transitory machine readable media may include: non-volatile memory, such as semiconductor memory devices (e.g., Electrically Programmable Read-Only Memory (EPROM), Electrically Erasable Programmable Read-Only Memory (EEPROM)) and flash memory devices; magnetic disks, such as internal hard disks and removable disks; magneto-optical disks; and CD-ROM and DVD-ROM disks.

The instructions 424 may be further transmitted or received over a communications network 426 using a transmission medium via the network interface device 420 utilizing any one of a number of transfer protocols (e.g., frame relay, internet protocol (IP), transmission control protocol (TCP), user datagram protocol (UDP), hypertext transfer protocol (HTTP), etc.). Example communication networks may include a local area network (LAN), a wide area network (WAN), a packet data network (e.g., the Internet), mobile telephone networks (e.g., cellular networks), Plain Old Telephone (POTS) networks, and wireless data networks, among others. In an example, the network interface device 420 may include one or more physical jacks (e.g., Ethernet, coaxial, or phone jacks) or one or more antennas to connect to the communications network 426. In an example, the network interface device 420 may include a plurality of antennas to wirelessly communicate using at least one of single-input multiple-output (SIMO), multiple-input multiple-output (MIMO), or multiple-input single-output (MISO) techniques. The term "transmission medium" shall be taken to include any medium that is capable of storing, encoding or carrying instructions for execution by the machine 400, and includes digital or analog communications signals or other medium to facilitate communication of such software. A transmission medium is a machine readable medium.

To recap and further explain, a numbered list of Aspects of the present subject matter are included below.

Aspect 1 can include or use subject matter (such as an apparatus, a system, a device, a method, a means for performing acts, or a device readable medium including instructions that, when performed by the device, can cause the device to perform acts, or an article of manufacture) such as can include or use an article of manufacture that can include or use a substrate. A sequence of characters can be arranged in one or more words in one or more rows on the substrate. The characters defining first contrast regions. A strikethrough path or other visual feature can extend through individual ones of the words, such as in a manner that can depend upon the word, such as upon a length of the word through which the strikethrough path extends.

Aspect 2 can include or use, or can optionally be combined with the subject matter of Aspect 1, to optionally include or use the strikethrough path such as to define a different second contrast region within one or more of the characters.

Aspect 3 can include or use, or can optionally be combined with the subject matter of one or any combination of Aspects 1 through 2 to optionally include or use the strikethrough path such as to define one or more first contrast regions extending between adjacent characters.

Aspect 4 can include or use, or can optionally be combined with the subject matter of one or any combination of Aspects 1 through 3 to optionally include or use the strikethrough path such as to define one or more first contrast regions in an interior region of a character.

Aspect 5 can include or use, or can optionally be combined with the subject matter of one or any combination of Aspects 1 through 4 to optionally include or use the strikethrough path such as can extend at an angle from a first character of a word to a last character of the word.

Aspect 6 can include or use, or can optionally be combined with the subject matter of one or any combination of Aspects 1 through 5 to optionally include or use the strikethrough path such as to extend at an angle from a first character of a word to a last character of the word, such as wherein the angle can depend upon the length of the word through which the strikethrough path extends.

Aspect 7 can include or use, or can optionally be combined with the subject matter of one or any combination of Aspects 1 through 6 to optionally include or use the strikethrough path such as can extend at an angle from one of a base or top of the first character of a first word to the other of a base or a top of the last character of the first word, such as wherein the angle can depend upon the length of the word through which the strikethrough path extends.

Aspect 8 can include or use, or can optionally be combined with the subject matter of one or any combination of Aspects 1 through 7 to optionally include or use the strikethrough path such as can continue from the other of a base or top of the first character of a second word, adjacent to the first word, to the one of the base or top of the last character of the second word.

Aspect 9 can include or use, or can optionally be combined with the subject matter of one or any combination of Aspects 1 through 8 to optionally include or use the strikethrough path being nonlinear such as undulating.

Aspect 10 can include or use, or can optionally be combined with the subject matter of one or any combination of Aspects 1 through 9 to optionally include or use the strikethrough path such as can extend through individual ones of the words at a variable height through the characters of the word.

Aspect 11 can include or use, or can optionally be combined with the subject matter of one or any combination of Aspects 1 through 10 to optionally include or use the strikethrough path such as can extend through individual ones of the word at a height that can depend upon a length or other characteristic of the word through which the strikethrough path extends.

Aspect 12 can include or use, or can optionally be combined with the subject matter of one or any combination of Aspects 1 through 11 to optionally include or use an article of manufacture that can include a security document such as can include the substrate, the sequence of characters, and the strikethrough path, wherein the strikethrough path is to inhibit tampering or forgery by re-arranging copied or excised characters into new words, with such re-arranging resulting in unalignment of two or more portions of the strikethrough path.

Aspect 13 can include or use, or can optionally be combined with the subject matter of one or any combination of Aspects 1 through 12 to optionally include or use a security document that can include a substrate. A sequence of characters can be arranged in one or more words in one or more rows on the substrate. The characters can define first contrast regions. A strikethrough path or other visual feature can extend through individual ones of the words, such that a combination of a particular character and the strikethrough path through the particular character, can be characteristic of the particular character and a position of the particular character within the word through which the strikethrough path extends.

Aspect 14 can include or use, or can optionally be combined with the subject matter of one or any combination of Aspects 1 through 13 to optionally include or use the strikethrough path such as can extend at an angle from one of a base or top of the first character of a first word to the other of a base or top of the last character of the first word, such as wherein the angle can depend upon the length or other characteristic of the word through which the strikethrough path extends.

Aspect 15 can include or use, or can optionally be combined with the subject matter of one or any combination of Aspects 1 through 14 to optionally include or use the strikethrough path continuing from the other of the base or top of the first character of a second word, adjacent to the first word, to the one of the base or top of the last character of the second word.

Aspect 16 can include or use, or can optionally be combined with the subject matter of one or any combination of Aspects 1 through 15 to optionally include or use the strikethrough path being nonlinear such as undulating.

Aspect 17 can include or use, or can optionally be combined with the subject matter of one or any combination of Aspects 1 through 16 to optionally include or use a method of printing or otherwise forming characters onto a substrate in a manner to inhibit tampering or forgery by re-arranging copied or excised characters into new words. The method can include printing or otherwise forming onto the substrate a sequence of characters, arranged in one or more words in one or more rows on the substrate, the characters defining first contrast regions. The method can also include printing or otherwise forming a strikethrough path extending through individual ones of the words in a manner such that re-arranging characters into new words results in unalignment of two or more portions of the strikethrough path.

Aspect 18 can include or use, or can optionally be combined with the subject matter of one or any combination of Aspects 1 through 17 to optionally include or use printing or otherwise forming the strikethrough path at an angle from one of a base or top of the first character of a first word to the other of a base or top of the last character of the first word.

Aspect 19 can include or use, or can optionally be combined with the subject matter of one or any combination of Aspects 1 through 18 to optionally include or use printing or otherwise forming the strikethrough path to continue from the other of the base or top of the first character of a second word, adjacent to the first word, to the one of the base or top of the last character of the second word.

Aspect 20 can include or use, or can optionally be combined with the subject matter of one or any combination of Aspects 1 through 19 to optionally include or use printing or otherwise forming the strikethrough path as undulating.

The above description includes references to the accompanying drawings, which form a part of the detailed description. The drawings show, by way of illustration, specific embodiments in which the invention can be practiced. These embodiments are also referred to herein as "aspects" or "examples." Such aspects or examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

The claimed invention is:

1. An article of manufacture, comprising:

a substrate;

a first sequence of characters, arranged in a first word on the substrate, the characters of the first word defining first contrast regions, optically contrasting the substrate; and a first strikethrough path extending visibly through the first contrast regions of all individual characters of the first word, the first strikethrough path extending through the first word at a first non-parallel angle relative a baseline of the first word from one of the baseline or a topline of the first word at a first character of the first word to the other of the baseline or topline of the first word at a last character of the first word;

wherein such first non-parallel angle is determined as a function of a length of the first word; and wherein the first strikethrough path continues from the other of the baseline or topline of the first word at the last character through a second word, adjacent to the first word.

2. The article of manufacture of claim 1, wherein the first strikethrough path defines a second contrast region within the characters, the second contrast region optically contrasting the first contrast regions.

3. The article of manufacture of claim 2, wherein the first strikethrough path defines one or more first contrast regions extending between adjacent characters.

4. The article of manufacture of claim 3, wherein the first strikethrough path defines a first contrast region in an interior region of a character.

5. The article of manufacture of claim 1, wherein the first strikethrough path is undulating.

6. The article of manufacture of claim 1, wherein the article of manufacture includes a security document including the substrate, the first sequence of characters, and the first strikethrough path, wherein the first strikethrough path inhibits tampering or forgery by re-arranging copied or excised characters of the first word into new words, with such re-arranging resulting in unalignment of two or more portions of the first strikethrough path.

7. The article of manufacture of claim 1, comprising:

a second sequence of characters, arranged in a second word on the substrate, the characters of the second word defining second contrast regions, the second word having a length different than the first word; and a second strikethrough path extending visibly through the second contrast regions of all individual characters of the second word, the second strikethrough path extending through the second word at a second non-parallel angle relative a baseline of the second word, wherein the second non-parallel angle is different than the first non-parallel angle;

wherein such second non-parallel angle is determined as a function of the length of the second word.

8. A security document, comprising:

a substrate;

a sequence of characters, arranged in a word on the substrate, the characters defining first contrast regions, optically contrasting the substrate; and a strikethrough path extending visibly through the first contrast regions of all individual characters of the word, the strikethrough path extending through the word at a non-parallel angle relative a baseline of the word from one of the baseline or a topline of the word at a first character of the word to the other of the baseline or topline of the word at a last character of the word;

wherein such non-parallel angle is determined as a function of a length of the word;

wherein the strikethrough path continues from the other of the baseline or topline of the word at the last character through a second word, adjacent to the word; and wherein the combination of a particular character and the strikethrough path through the particular character is characteristic of a position of the particular character within the word.

9. The security document of claim 8, wherein the strikethrough path is undulating.

10. A method of printing or otherwise forming characters onto a substrate in a manner to inhibit tampering or forgery by re-arranging copied or excised characters into new words, the method comprising:

printing or otherwise forming onto the substrate a sequence of characters, arranged in a word on the substrate, the characters defining first contrast regions, optically contrasting the substrate; and printing or otherwise forming a strikethrough path extending visibly through the first contrast regions of all individual characters of the word, the strikethrough path extending through the word at a non-parallel angle relative a baseline of the word from one of the baseline or a topline of the word at a first character of the word to the other of the baseline or topline of the word at a last character of the word;

wherein such non-parallel angle is determined as a function of a length of the word, such that a rearrangement of characters of the word into new words results in unalignment of two or more portions of the strikethrough path; and wherein the strikethrough path continues from the other of the baseline or topline of the word at the last character through a second word, adjacent to the word.

11. The method of claim 10, comprising printing or otherwise forming the strikethrough path with the strikethrough path undulating.

* * * * *